US010213675B1

(12) United States Patent
Novosel, Sr.

(10) Patent No.: US 10,213,675 B1
(45) Date of Patent: Feb. 26, 2019

(54) GOLF SWING TRAINING APPARATUS AND SYSTEM

(71) Applicant: John Michael Novosel, Sr., Leawood, KS (US)

(72) Inventor: John Michael Novosel, Sr., Leawood, KS (US)

( * ) Notice: Subject to any disclaimer, the term of this patent is extended or adjusted under 35 U.S.C. 154(b) by 0 days.

(21) Appl. No.: 15/974,560

(22) Filed: May 8, 2018

Related U.S. Application Data

(60) Provisional application No. 62/543,440, filed on Aug. 10, 2017.

(51) Int. Cl.
*A63B 69/36* (2006.01)
*A63B 102/32* (2015.01)

(52) U.S. Cl.
CPC ..... *A63B 69/3632* (2013.01); *A63B 69/3641* (2013.01); *A63B 2102/32* (2015.10)

(58) Field of Classification Search
CPC ..... A63B 69/3647
USPC ..... 473/219, 223, 226, 231, 256
See application file for complete search history.

(56) References Cited

U.S. PATENT DOCUMENTS

| | | | | |
|---|---|---|---|---|
| 7,857,706 | B2 | 12/2010 | Novosel | |
| 8,012,033 | B2 | 9/2011 | Novosel, Jr. | |
| 2006/0287122 | A1* | 12/2006 | Ray | A63B 69/3638 473/228 |
| 2010/0022319 | A1* | 1/2010 | Scaperotti | A63B 21/0088 473/228 |
| 2015/0005091 | A1* | 1/2015 | Phillips | A63B 69/3632 473/228 |
| 2017/0239549 | A1* | 8/2017 | Steenberg | A63B 15/00 |

* cited by examiner

*Primary Examiner* — Raeann Gorden
(74) *Attorney, Agent, or Firm* — Seth M. Reiss

(57) ABSTRACT

A golf training aid 20 that provides to the user unmistakable positive feedback how to use the hands, wrists and forearms in the golf swing to affect what has been popularly called 'Ben Hogan's Secret Move,' particularly during the transition of the golf swing. Golf training aid 20 also provides the golfer unmistakable feedback as to whether they have executed the correct movement that Hogan explained in his 1955 Life magazine article.

21 Claims, 4 Drawing Sheets

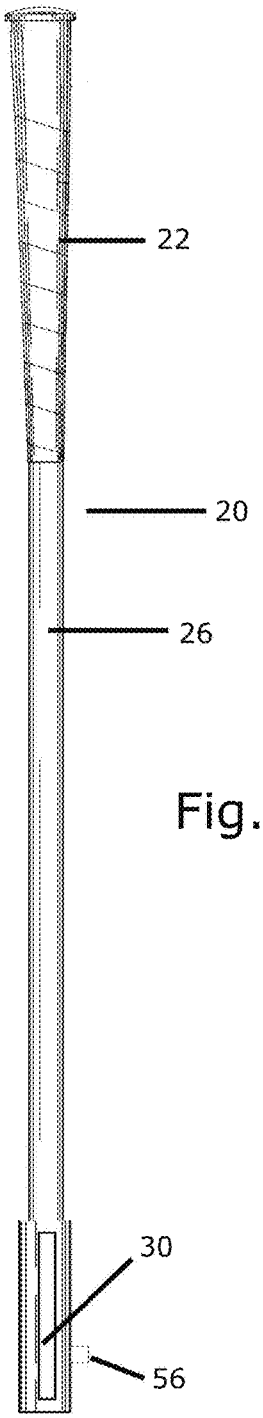
Fig.1
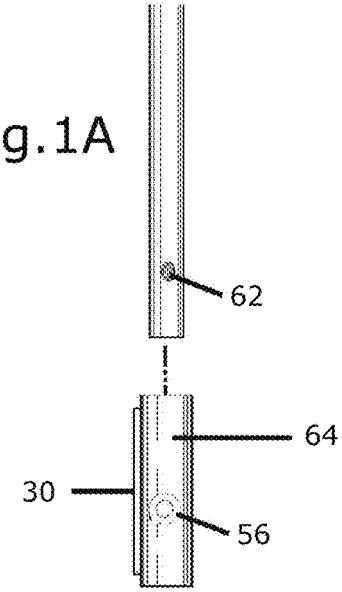
Fig.1A
Fig.1B
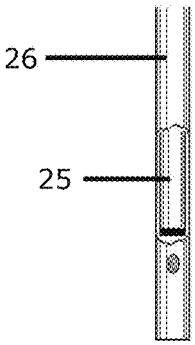
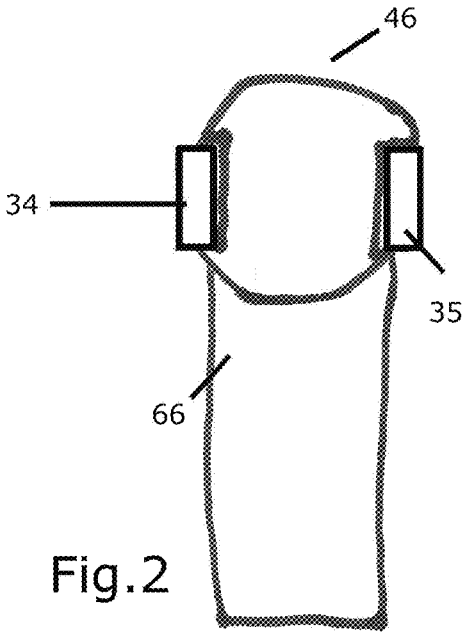
Fig.2

Fig. 7
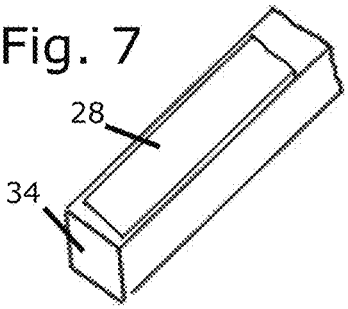
Fig. 7A
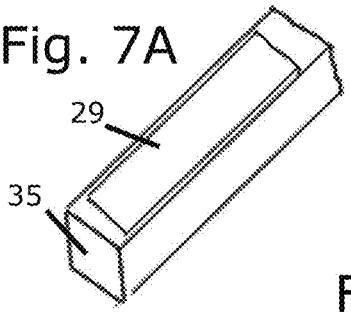
Fig. 8A
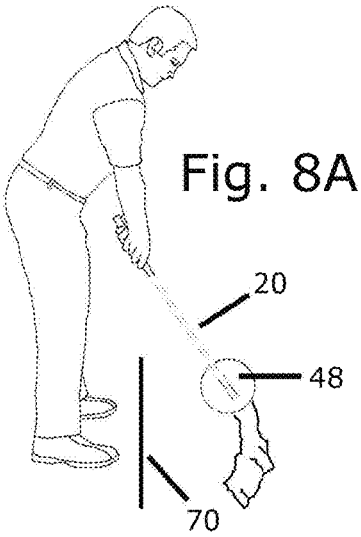
Fig. 8
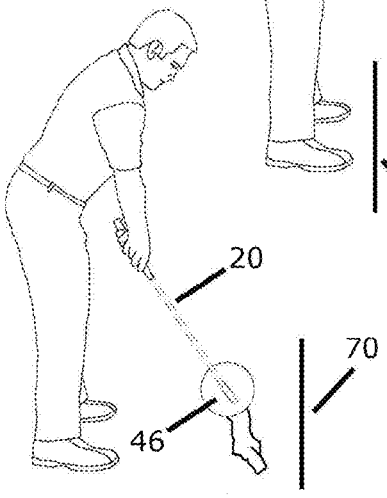
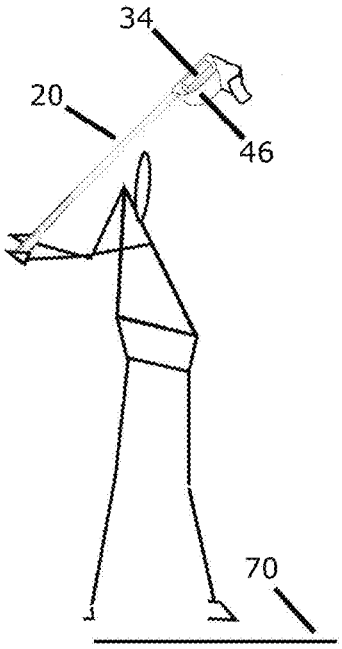
Fig. 9
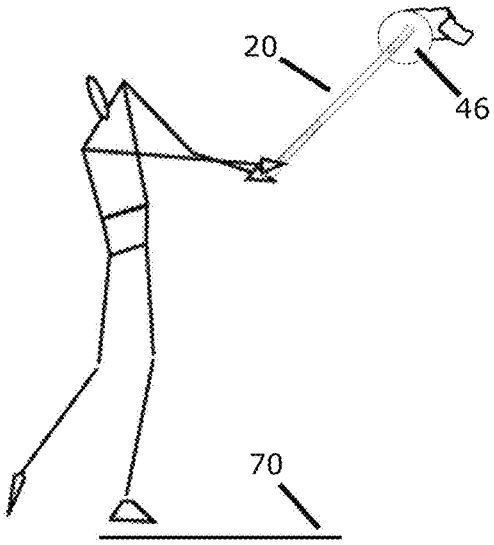
Fig. 10

GOLF SWING TRAINING APPARATUS AND SYSTEM

CROSS-REFERENCE TO RELATED APPLICATIONS

This U.S. Non-Provisional Utility patent application claims the benefit, under 35 U.S.C. § 119, of U.S. Provisional Patent Application Ser. No. 62/543,440, filed Aug. 10, 2017 by the present inventor, the contents of which are incorporated herein in their entirety.

STATEMENT REGARDING FEDERALLY SPONSORED RESEARCH

The invention described herein was not made pursuant to a government agency grant or contract. No government funds were utilized in the described invention.

FIELD OF THE INVENTION

This invention relates to golf training aids, specifically to a golf swing training aid that teaches the golf swing that Ben Hogan explained in his Aug. 8, 1955 Life magazine article. More particularly, this invention describes apparatus, methods and a system that teaches the golfer exactly how to use his hands, wrists and forearms in the golf swing to effect what has been popularly called 'Ben Hogan's Secret Move.'

BACKGROUND OF THE INVENTION

This invention gives the golfer unmistakable feedback as to whether the golfer has executed the correct movements in the golf swing that Ben Hogan explained in his Aug. 8, 1955 Life magazine article.

Mr. Hogan described this move as "I cupped the wrist gradually backward and inward on the backswing so that the wrist formed a slight V at the top of the swing. The angle was not more than four or six degrees, almost invisible to the human eye. This simple maneuver, in addition to the pronation, had the effect of opening the face of the club to the widest possible extreme at the top of the swing. At this point the swing had been made hook proof. No matter how much wrist I put into the downswing, no matter how hard I swung or how hard I tried to roll into and through the ball, the face of the club could not close fast enough to become absolutely square at the moment of impact. The result was that lovely, long-fading ball which is a highly effective weapon on any golf course."

Through the years there have been many books and articles promising to tell golfers how to swing as Mr. Hogan described in his Aug. 8, 1955 Life magazine article. But the inventor is unaware of any golf training aids that provides the feel of what Mr. Hogan described.

The problem is that there is has been no mechanism to give the correct feedback to the golfer, especially at the transition of the swing from backswing to downswing, one of the most important parts of the swing.

SUMMARY OF THE INVENTION

The problem of teaching the golfer the swing described by Mr. Hogan in 1955 is solved by the present invention, a golf swing training system comprising apparatus, methods and a system to provide correct feedback to the golfer enabling the golfer to learn and use the Hogan swing when playing golf.

In order to teach the 'Hogan Secret' correctly, you have to be able to feel it. That's what the golf swing training aid of the present invention actually does. The invention also teaches the golfer how to achieve the correct swing plane as described in Hogan's book. It does this by making the swing plane observable by means of a segment of stretchable cloth attached to a layered base that is attached to the end of a clubhead-less golf club.

Also there have been no golf training aids that would give unmistakable positive feedback to the user as how to use the hands, wrists and forearms in the golf swing to effect what has been popularly called the 'Hogan Secret Move.'

OBJECTS OF THE INVENTION

It is, therefore, a primary object of the present invention to provide apparatus, methods and a system for training a golfer to learn at the same time the dual elements of correct forearm rotations and swing plane as exhibited by Ben Hogan and today's touring professionals; and as a corollary to the foregoing object, providing for the correct movement of the way a golfer's hands, wrists and forearms work in the 'Hogan Secret Move.'

The golfing aid of the subject invention will help the golfer to identify the positions at the top of the backswing and the positions at the release of the club that mimic those of the professional touring player described by Mr. Hogan.

Yet another object of the present invention is to provide a training system that can be used anywhere without a golf ball, but additionally provides a specially weighted golf club that mimics the golf swing training club when hitting balls.

Another object of the present invention is to provide a swing training system that can be used to provide resistance through the use of multiple attachments to the shaft of the training club and varying lengths of material to provide resistance.

Other objects will become apparent in view of the entire specification, drawings and claims.

DESCRIPTION OF THE DRAWINGS

FIG. 1 is a view of the basic golf swing training club with removable sleeve on shaft bottom.

FIG. 1A illustrates how the removable round sleeve is attached to the shaft of the golf swing training club.

FIG. 1B shows how the inside of the golf swing training club shaft is weighted FIG. 2 shows the back side of the multi-layered base with weights attached.

FIG. 7 is a perspective view of the rectangular detachable weight with loop material that attaches to the left side of the back of the multi-layered base as illustrated in FIG. 3.

FIG. 7A is a is a perspective view of the rectangular detachable weight with loop material that attaches to the right side of the back side of the multi-layered base as illustrated in FIG. 3.

FIG. 8 is a rear view showing the golfer in an address position with the golf swing training club with multi-layered base having short stretchable fabric releasably attached to bottom thereof.

FIG. 8A is a rear view showing the golfer in an address position with the golf swing training club with multi-layered base having long stretchable fabric releaseably attached to bottom thereof.

FIG. 9 is a view taken at the top of the backswing showing how the rectangular detachable weights on the bottom of the golf swing training club cause the multi-layered base to drape over the shaft on both sides.

FIG. 10 is a belt buckle view showing the golfer using the golf swing training club of the present invention at the finish of the training swing.

REFERENCED NUMERALS IN DRAWING

Figure 5:
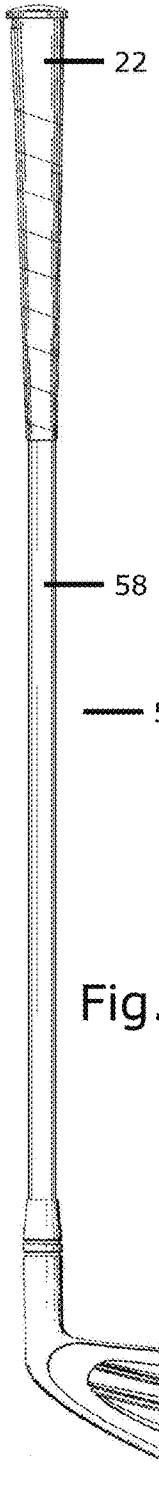
FIG. 5 is a view of a golf club weighted exactly like the golf swing training club of the present invention.

20 Golf swing training club
22 Grip
24 Hook material on the removable rectangular head
25 Weight for shaft
26 Golf swing training club shaft
28 Loop material on the left side detachable weight
29 Loop material on the right side detachable weight
30 Hook material on removable sleeve
34 Left side rectangular detachable weight
35 Right side rectangular detachable weight
36 Left side hook material on the back of multi-layered base with short stretchable fabric
38 Right side hook material on the back of multi-layered base with short stretchable fabric
42 Loop material on the front of multi-layered base
44 Neoprene with nylon fabric on each side
46 Multi-layered base with short stretchable fabric sewn into the bottom
48 Multi-layered base with long stretchable fabric sewn into the bottom
50 Golf club capable of hitting balls exactly weighted like the golf swing training club of the present invention
52 Golf clubhead
54 Removable spherical head
56 Set screw
58 Golf shaft
60 Removable rectangular head
62 Threaded hole for set screw
64 Removable round sleeve
66 Short stretchable fabric
68 Long stretchable fabric
70 Target line
72 Hook material on removable spherical head
74 Hook material on left side of the back of multi-layered base with long stretchable fabric
76 Hook material on the right side of the back of multi-layered base with long stretchable fabric

DETAILED DESCRIPTION OF PREFERRED EMBODIMENTS

Referring initially to FIGS. 1 through 1B, there is shown the golf swing training club 20 of the subject invention. Club 20 has a grip 22 section and a golf swing training club shaft 26 section. The grip 22 could be a regular golf grip available at any pro shop, but the shaft 26 would be a round tube of aluminum available at any of the aircraft type websites that sell aluminum tubing. The preferred length of shaft 26 would be 41 inches, but other lengths are also envisioned. At the end of the shaft 26, a removable round sleeve 64 is attached by means of a set screw 56. Said removable round sleeve 64 has hook material 30 adhered to it along one side. Removable round sleeve 64 is attached to shaft 26 by means of a set screw 56 screwed into a threaded hole 62 for set screw formed in shaft 26.

Shaft 26 also has a weight 25 epoxied into the end of it, so that it amplifies the feeling of where the golf clubhead 52 would normally be in a golf swing motion. Removable round sleeve 64 is another section of aluminum tubing that could be sourced from the same place as the shaft 26 section. The set screw 56 is a normal screw found in any hardware store.

FIG. 2 shows a multi-layered base 46 from the back with a short segment of stretchable fabric 66 sewn into its bottom. The preferred length of fabric 66 is 21 inches although longer and shorter lengths are also contemplated. Also shown in FIG. 2 is how a left side rectangular detachable weight 34 and a right side rectangular detachable weight 35 are located one on each side of base 46. Detachable weights 34 and 35 are attached to base 46 by the mating their respective hook and loop surfaces. Detachable weights 34 and 35 are used to make the student feel what Mr. Hogan described as the "cupping of the wrist gradually backward and inward on the backswing so that the wrist formed a slight V at the top of the swing." When the golf student gets stretchable fabric 66 of base 46 to droop over club 20 (as shown in FIG. 9), then the student knows she or he has done the top of the backswing move correctly.

Figure 3:
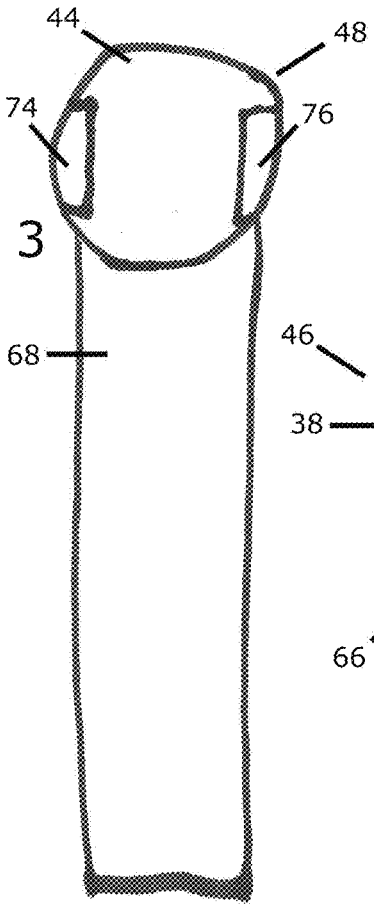
FIG. 3 shows the long-tailed multi-layered base from the back and the hook material thereupon.

Illustrated in FIG. 3 is the back of the multi-layered base 48 with a long segment of stretchable fabric 68 sewn into the bottom thereof. Also shown in FIG. 3 is how a hook material 74 on the left side of the back of multi-layered base 48 with stretchable fabric and a hook material 76 on the right side of the back of multi-layered base 48 with stretchable fabric are sewn into each side of the top of base 48. The preferred length of long stretchable fabric 68 is 34 inches, although longer and shorter lengths are also contemplated.

Figure 4:
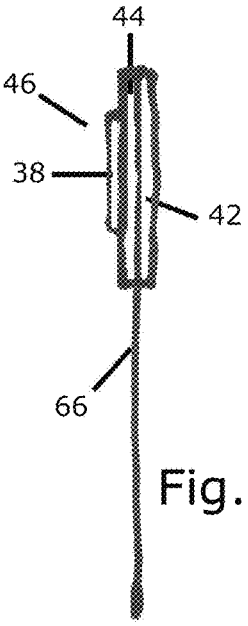
FIG. 4 is a right side view of the short-tailed multi-layered base.

FIG. 4 is a right side view of base 46 illustrated in FIG. 2 without right side rectangular detachable weight 35 or left side rectangular detachable weight 34. FIG. 4 shows how base 46 is layered, with a front layer 42 fabricated from loop material, middle layer 44 fabricated from wetsuit type material being neoprene covered with nylon fabric on both sides, and a back layer 38 comprised of hook material.

Figure 4A:
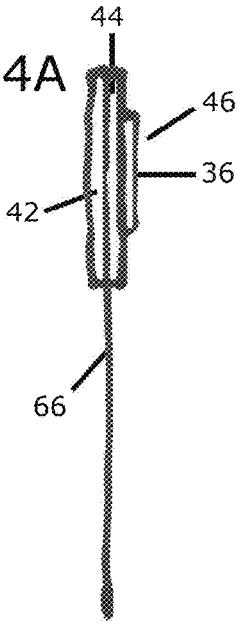
FIG. 4A is a left side view of the short-tailed multi-layered base.

FIG. 4A is a left-side view of the base 46 illustrated in FIG. 2 (again without right side rectangular detachable weight 35 or left side rectangular detachable weight 34) demonstrating how base 46 is layered with a front layer 42 of loop material, middle layer 44 of nylon fabric covered neoprene material, and a back layer 36 of hook material. FIGS. 4 and 4A also illustrate short stretchable fabric 66 sewn into and extending out from the bottom of base 46.

Figure 5A:
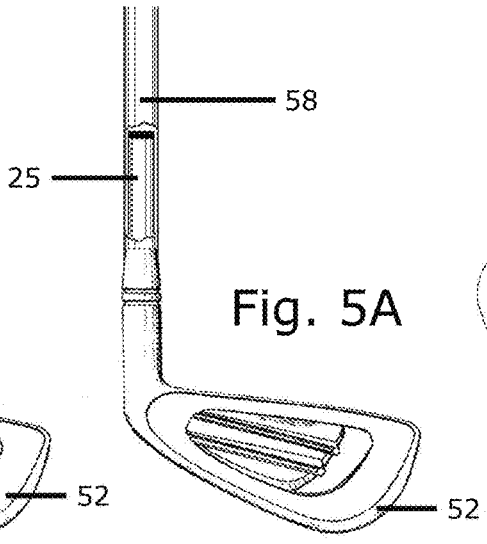
FIG. 5A is a cutaway view showing how the weight is positioned inside the golf club shaft exactly like the weight in the golf swing training club of the present invention.

Illustrated in FIGS. 5 through 5A is a specially weighted golf club 50 capable of hitting golf balls. Golf club 50 is weighted exactly like the golf swing training club 20 of the present invention. A weight 25 is epoxied into the golf shaft 58 of golf club 50 to make swinging club 50 feel exactly like swinging golf swing training club 20.

Figure 6:
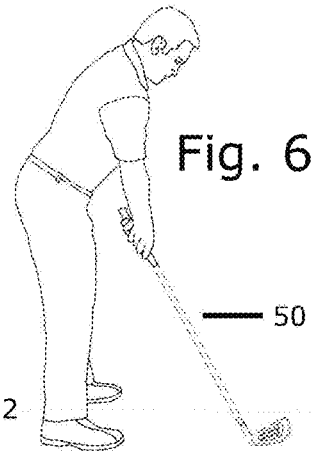
FIG. 6 illustrates a golfer preparing to hit balls with a the golf club depicted in FIGS. 5 and 5A weighted exactly like the golf swing training club.

FIG. 6 shows a golfer at address getting ready to swing with club 50.

FIG. 7 is a perspective view of left side detachable weight 34 showing the loop material 28 on detachable weight 34 used to attached weight 34 to base 46 as shown in FIG. 2.

FIG. 7A is a perspective view of right side rectangular detachable weight 35 showing the loop material 29 on right side detachable weight 35 used to attached weight 35 to base 46 as shown in FIG. 2.

FIG. 8 is a view from behind the golfer using the training club 20 with multi-layered base 46 having a short stretchable segment fabric 66 sewn into its bottom.

FIG. 8A is a view from behind the golfer using the training club 20 with the multi-layered base 48 having a long stretchable fabric segment 68 sewn into its bottom. Both the short stretchable segment 66, and the long stretchable segment 68 is preferably made of stretch polyester fabric, which can be purchased at any fabric store locally or online. Other stretchable fabrics may also be used with similar results.

FIG. 9 is a belt buckle stick figure representational view of the golfer in FIG. 8 using the training club 20 with the multi-layered base 46 having left side rectangular detachable weight 34 and the right side rectangular detachable weight 35 (hidden in FIG. 9) both attached. Left and right side weights 34 and 35 attach to multi-layered base 46 by means of the hook material on detachable weights 34 and 35 and loop material on base 46.

Detachable weights 34 and 35 cause the multi-layered base 46 to drape over the shaft 26 at the top of the backswing. This draping over the shaft 26 causes the golfer's wrists to do what Mr. Hogan described in the Life magazine article, "I cupped the wrist gradually backward and inward on the backswing so that the wrist formed a slight V at the top of the swing. The angle was not more than four or six degrees, almost invisible to the human eye."

FIG. 10 is a belt buckle view stick figure representational view of the golfer in FIG. 8 using the training club 20 with the multi-layered base 46 shown arriving at the finish of a training swing.

Figure 11:
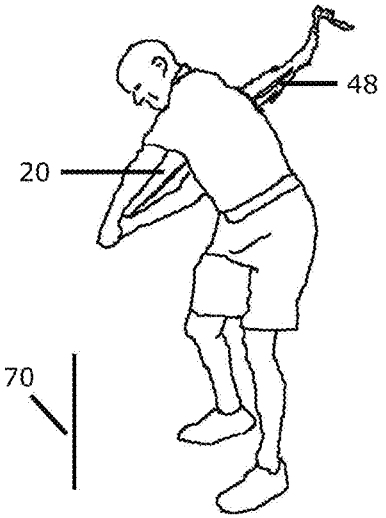
FIG. 11 is a front view of the golfer shown from the rear in FIG. 8 using the golf swing training club of the present invention, as he is coming down during the downswing, with the long segment of the multi-layered base indicating that the golfer is on the correct swing plane.

FIG. 11 is a front view of the golfer in FIG. 10 demonstrating how the swing plane can be determined by the multi-layered base 48 with long stretchable fabric 68. The angle shown by multi-layered base 48 with long stretchable segment is about forty-five degrees, which is optimal.

Figure 12:
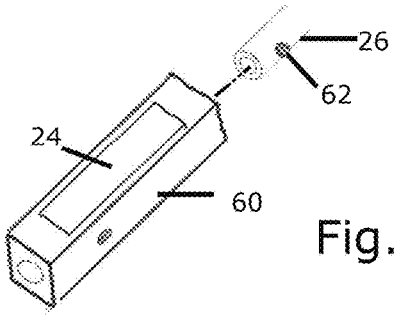
FIG. 12 shows a perspective view of the removable rectangular head of the golf aid of the present invention.

FIG. 12 is a perspective view of the removable rectangular head 60 with the hook material 24 thereupon and how it is removably attached to shaft 26.

Figure 13:
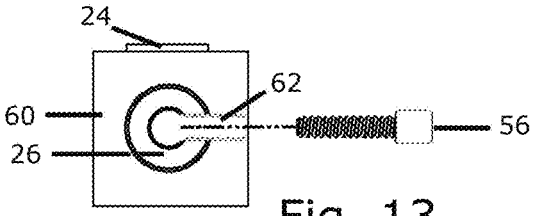
FIG. 13 shows how the removable rectangular head of the invention is attached to the golf swing training club shaft.

FIG. 13 is a bottom view of removable rectangular head 60 with the hook material 24, and how it is removably attached to shaft 26 using set screw 56 being screwed into the threaded hole 62 for set screw.

Figure 14:
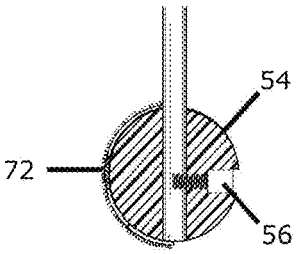
FIG. 14 is a cross-sectional view of an alternative embodiment spherical clubhead removably attached to the golf swing training club shaft.

FIG. 14 illustrates how an alternative embodiment removable spherical head 54 is removably attached to shaft 26 using set screw 56. Spherical head 54 can be made out of wood or plastic.

Figure 15:
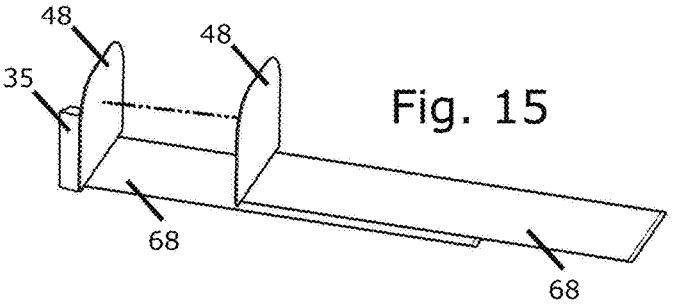
FIG. 15 illustrates how two multi-layered bases of the golf swing training club of the present invention can be matted together.

FIG. 15 shows how a golfer can mate multi-layered base 48 to another base 48 that already has both a left and right side rectangular detachable weight 34 (not shown) and 35 attached, thereby increasing the effect of the system by increasing the weight attached to the training club 20. The hook material 74 and the hook material 76 on the back of the second base 48 attaches to the loop material 42 on the front of the first base 48.

Figure 16:
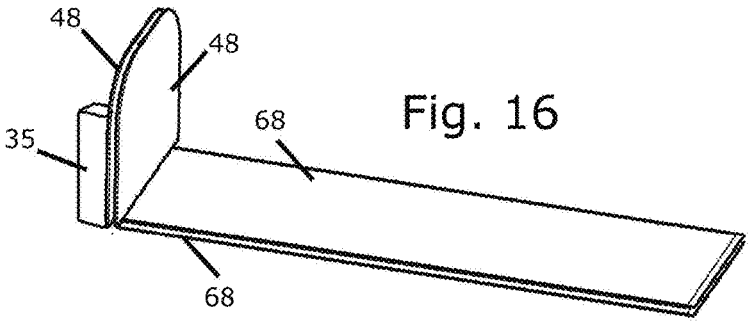
FIG. 16 shows the two bases in their final position after being mated as shown in FIG. 15.

FIG. 16 shows how the first base 48 and the second base 48 have come together as described in FIG. 15.

Operation

In order to use the golf swing training system of the present invention, the golfer gets into the address position shown in FIG. 8, with training club 20 attached to either short segment multi-layered base 46 or long segment multi-layered base 48, or with multiple multi-layered bases 48 attached as shown in FIG. 16. The golfer then swings training club 20 to the top of the backswing shown in FIG. 9. Once there, the golfer allows multi-layered base 46 or 48 to drape over shaft 26. This causes the student to experience what Mr. Hogan described as the "cupping of the wrist gradually backward and inward on the backswing so that the wrist formed a slight V at the top of the backswing."

Once arrived at the top of the backswing shown in FIG. 9, the golfer attempts to throw multi-layered base 46 (or 48) off of training club 20. The student knows that training club 20 and the multi-layered base 46 (or 48) are two separate elements that are normally two separate pieces. This determination to throw the multi-layered base 46 (or 48) off training club 20 has the effect of enabling the golfer to achieve the correct release of the swing with the correct timing. Once this is accomplished, the student ends up at the finish of the swing as shown in FIG. 10.

After completing the training exercise explained above, the golfer then takes club 50 with clubhead 52 which is weighted exactly the same as training club 20 and make the same motion with the club 50 while hitting an actual golf ball. This serves to recreate the same feel that the student had with training club 20 on the backswing, and also when trying to throw the clubhead down the middle of the fairway into the forward swing, just as the student tried to do with identically weighted training club 20 while attached to multi-layered base 46 (or 48) with stretchable fabric 66 (or 68).

SUMMARY AND SCOPE

Thus we can see that this training club 20 provides the golfer with unmistakable feedback, since it exactly mirrors the motion of the golfer's hands, wrists and forearms. Furthermore, training club 20 allows the golfer to feel the correct transition. In addition, the upper 22 and lower 26 sections of the shaft of training aid 20 provide unmistakable feedback by the way the shaft sections remain lined up in the various checkpoints of the swing. It also should be clear that training club 20 allows the golfer to feel the correct release of the golf training club 20 through the ball. This allow both inexperienced and scratch golfers to improve their ball striking abilities.

It is to be understood that the present invention is not limited to the disclosed embodiments but may also be expressed in other embodiments, by rearrangement, modification or substitution of parts or steps, within the spirit of the invention.

The invention claimed is:

1. A golf swing training aid comprising:

a shaft with grip at one end thereof;

a weight formed inside the non-grip end of said shaft to weight said non-grip end beyond the weight provided by the shaft;

a base with flexible tail that extends out a distance from said base;

wherein the non-tail end of said base is releasable attached to the non-grip end of said shaft in a manner such that, when the said training aid is swung to the top of a backswing, the base with flexible tail drapes over the non-grip end of said shaft.

2. The golf swing training aid of claim 1, further comprising a sleeve affixed to the non-grip end of said shaft that removeably receives the non-tail end of said base.

3. The golf swing training claim of claim 2, wherein said sleeve is selected from a group of sleeves consisting of sleeves that are rectangular in cross-section and sleeves that are circular in cross section.

4. The golf swing training aid of claim 1, further comprising weights releasably attached to each side of said base.

5. The golf swing training aid of claim 1, wherein said base comprises a layer of nylon lined neoprene material with a layer of hook material on one side and a layer of loop material on the opposed side.

6. The golf swing training aid of claim 1, wherein the tail extends out approximately 21 inches from the base, plus or minus 5 inches.

7. The golf swing training aid of claim 1, wherein the tail extends out approximately 34 inches from the base, plus or minus 5 inches.

8. The golf swing training aid of claim 1, wherein a plurality of bases with tails extending therefrom are releasably attached to the non-grip end of said golf shaft.

9. The golf swing training aid of claim 8, wherein the tails of such bases are the same length.

10. The golf swing training aid of claim 9, wherein the tails of such bases are different lengths.

11. The golf swing training aid of claim 1, wherein said flexible tail comprises a strip of stretchable fabric.

12. A golf swing training method comprising the steps of:

taking a golf swing training aid having a shaft with grip at one end thereof and weight formed inside the opposing end of said shaft weighting said non-grip end beyond the weight provided by said shaft;

releasably attaching to said non-grip end of said shaft a base with flexible tail that extends out a distance from said base;

swinging said training aid backwards and upwards until said base with flexible tail drapes over the non-grip end of said shaft; and swinging said training aid downwards and forwards with the intention of throwing said base with flexible tail off said shaft.

13. The golf swing training method of claim 12, wherein the base further comprises weights detachably attached to either side thereof.

14. The golf swing training method of claim 12, wherein more than one base with flexible tail is releasably attached to the non-grip end of said shaft.

15. The golf swing training method of claim 14, wherein said flexible tails are of the same length.

16. The golf swing training method of claim 14, wherein said flexible tails are of different lengths.

17. A golf swing training method comprising the steps of:

taking a golf swing training aid having a shaft with grip at one end thereof;

releasably attaching to said non-grip end of said shaft a base having weights attached thereto with flexible tail that extends out a distance from said base;

swinging said training club backwards and upwards until said base with flexible tail drapes over the non-grip end of said golf shaft;

swinging said training club downwards and forwards with the intention of throwing said base with flexible tail off said shaft;

taking a golf club having a shaft with grip at one end, a club head at the opposing end for hitting balls, and a weight formed inside the non-grip end of said shaft such that said golf club is weighted substantially identically to said golf swing training aid;

addressing a golf ball;

swinging said training club backwards and upwards; and swinging said training club downwards and forwards to hit the golf ball using the feeling developed with the golf swing training aid to throw the base with flexible tail off said shaft.

18. The golf swing training method of claim 17, wherein the non-grip end of the shaft of said training aid is weighted beyond the weight provided by said shaft.

19. The golf swing training method of claim 17, wherein more than one base with flexible tail is releasably attached to the non-grip end of the shaft of said training aid.

20. The golf swing training method of claim 19, wherein said flexible tails of said training aid are of different lengths.

21. A golf swing training aid comprising:

a shaft with grip at one end thereof;

a base with flexible tail that extends out a distance from said base;

weights releasably attached to each side of said base;

wherein the non-tail end of said base is releasable attached to the non-grip end of said shaft in a manner such that, when the said training aid is swung to the top of a backswing, the base with flexible tail drapes over the non-grip end of said shaft.

* * * * *